United States Patent [19]

Bengtsson

[11] 4,296,531

[45] Oct. 27, 1981

[54] STRAP FASTENING MEANS

[76] Inventor: Sigurd W. Bengtsson, Bruksgatan 17, 41451 Gothenburg, Sweden

[21] Appl. No.: 46,702

[22] Filed: Jun. 8, 1979

[30] Foreign Application Priority Data

Jun. 9, 1978 [SE] Sweden ..... 7806704

[51] Int. Cl.[3] ..... A44B 11/25

[52] U.S. Cl. ..... 24/200; 24/230 R

[58] Field of Search ..... 24/200, 197, 196, 193, 24/182, 75, 74 A, 74 R, 230 R

[56] References Cited

U.S. PATENT DOCUMENTS

| | | | |
|---|---|---|---|
| 3,192,588 | 7/1965 | White | 24/200 |
| 3,376,613 | 4/1968 | Lindblad | 24/200 |
| 3,760,466 | 9/1973 | Leblanc | 24/200 |

FOREIGN PATENT DOCUMENTS

| | | | |
|---|---|---|---|
| 917176 | 12/1946 | France | 24/74 |
| 1394524 | 2/1965 | France | 24/200 |
| 25625 | 8/1900 | United Kingdom . | |

*Primary Examiner*—Roy D. Frazier
*Assistant Examiner*—Alexander Grosz
*Attorney, Agent, or Firm*—Hill, Van Santen, Steadman, Chiara & Simpson

[57] ABSTRACT

A strap buckle comprises a generally planar housing in which at least three bars extend in parallel relationship between opposite side walls for the retention of a strap end. A first strap passage extends substantially parallel to the plane of the housing and is defined, at one side by at least one of the bars, while the other side of the passage is defined by two further ones of said bars having a second strap passage therebetween.

The strap end can pass through the first strap passage, around one of the two further bars, inwardly through the second strap passage, and out through a portion of the first strap passage, between the incoming part of the strap and the other of the two further bars.

5 Claims, 4 Drawing Figures

FIG. 1
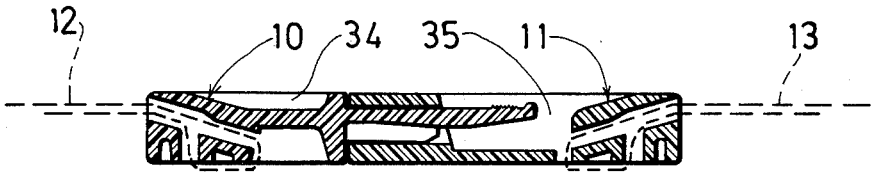
FIG. 2
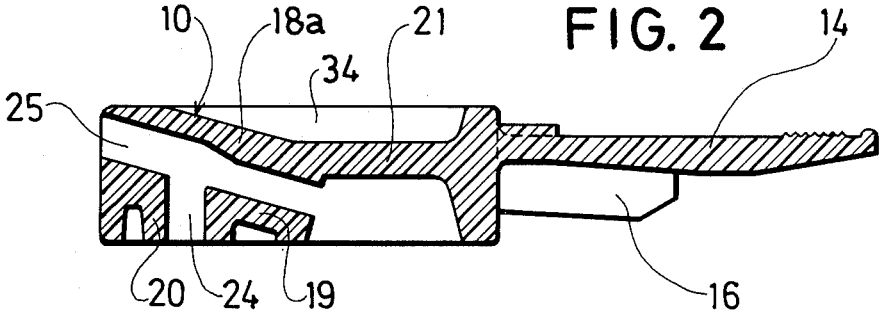
FIG. 3
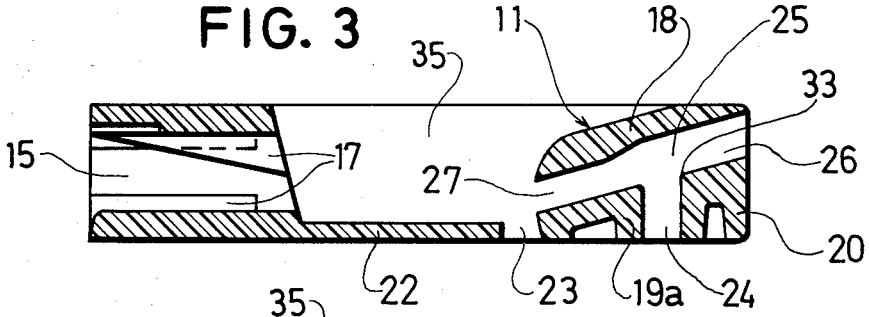
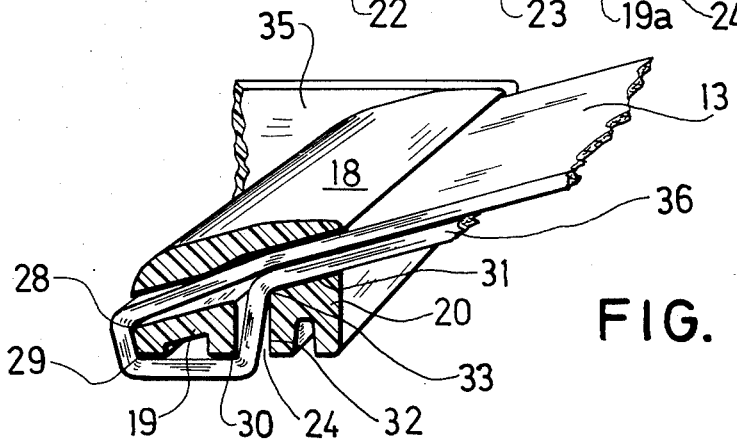
FIG. 4

STRAP FASTENING MEANS

BACKGROUND OF THE INVENTION

1. Field of the Invention

This invention pertains to a buckle, and more specifically to the structure by which a strap is secured to a buckle.

2. Prior Art

When using a strong strap for various purposes, there is usually a requirement that the length of the strap be adjustable, and it is also desirable that the strap should not slip, even if it is subjected to a heavy load.

In order to prevent slipping of the strap, it has been proposed to use buckles provided with dented, or sharp edges, over which the strap was bent. Such usage causes a wearing of the strap after some time of use, so the strength of the strap will be reduced. According to other proposals the strap must be formed in complicated loops, which prevents any simple and rapid adjustment of the length of the strap to be made. There are buckles including parts which are movable in relation to each other, but those constructions cause increased production and attachment costs, and are furthermore unsuitable when heavy loads may occur. There is furthermore a tendency that such a buckle will to release its grip when the load is removed.

SUMMARY OF THE INVENTION

A buckle according to the invention is especially suited to be used with seat belts in cars, and also with certain types of life vests, which are constructed to enable lifting the wearer out of the sea by applying a hoisting device to the vest.

A strap buckle according to the invention comprises a substantially planar housing having a locking portion and an attachment portion comprising at least three parallel bars extending between two side walls of the housing. The housing may be adapted to be fitted to a piece of clothing, or to an object, but may also be constructed to engage another housing, so that it will be possible to connect two straps together.

The invention includes bars that define a first strap passage extending substantially parallel to the plane of the housing, two of the bars, located at one side of the first passage being separated by a second strap passage substantially perpendicularly to the plane of the housing.

One bar, located at the side of said first passage opposite said two bars preferably has an extent in the direction of said first passage corresponding to the extent of said two bars, plus the breadth of the second passage separating the latter.

A second of said bars remotely located with respect to the entrance end of the first strap passage, preferably has plane surfaces, intersecting at sharp corners, substantially at right angles.

The surfaces of said second bar at the outlet end of the first strap passage preferably intersect at an angle less than 90°.

Said second bar is preferably dimensioned so it, at a maximum of estimated load will be elastically deformed so as to decrease the breadth of the second strap passage. As a result, the friction between the strap and the bars will be increased, while simultaneously said second bar, by being supported the bar at the other side of said second passage, will be better suited to take up heavy loads without any risk of breaking.

The first strap passage preferably is arranged with an inclination with respect to the plane of the housing, so the heights of the second and of the third bars will decrease in the direction from the entrance end of the first strap passage towards its outlet end. On occasions this strap passage may be arranged so its inclination runs in the opposite direction.

BRIEF DESCRIPTION OF THE DRAWING

FIG. 1 shows a strap buckle according to the invention, having two interengaging parts, FIGS. 2 and 3, on a larger scale, show a male and a female component forming part of the buckle shown in FIG. 1, and FIG. 4 is a perspective view showing how the strap passes past the three bars.

DESCRIPTION OF A PREFERRED EMBODIMENT

FIG. 1 shows a double strap attaching means forming a buckle including a male part and a female part adapted to be interconnected. Each part is provided with a means 10 and 11, respectively, for the attachment of a strap end 12 or 13, respectively.

The male part at the attachment means 10, and the female part at the attachment means 11 are shown separately in FIGS. 2 and 3, and may have interengaging, locking members of known design. They may for instance be formed as shown in U.S. Pat. No. 3,167,835. Each part is formed like a substantially planar housing, the male part having a protruding, resilient tongue 14, which may be slid into a passage 15 in the female part. The tongue 14 is provided with laterally extending projections, which engage mating shoulders on the female part. A separation of the parts is obtainable by pressing a serrated tongue downwards. There are further cooperating grooves and ledges 16 and 17, respectively, on the male and female parts, which govern the male part, while it is being introduced into the female part, and which prevent the parts from being fitted together with one of them rotated to a 180° position from that shown.

One of the parts, preferably the female one, may be constructed in such a manner that it may be sewn or riveted to a piece of clothing, or to an object, for instance a harness, where it is desirable to attach a strap.

When there are strap attaching means at both parts of a buckle, as shown in FIG. 1, it is usually sufficient that the length of one of the straps be adjustable. Experience has however shown, that an attaching means according to the invention is so safe, i.e. the strap will not slide, that it is simpler and cheaper to introduce a strap end into the buckle than sewing or riveting the strap to the buckle in a conventional manner.

The attachment portion proper includes three bars 18, 19 and 20, which extend in parallel between pairs of side walls 34 and 35, in the male part and in the female part respectively. The shape of the bars 18 and 19 will vary somewhat, depending upon whether the bars are being fitted in a male part, or in a female part.

In order to increase the strength of the bar 18*a* used, in a male part, it merges into a flat member 21 which, in turn, merges into the tongue 14. For the same purpose the female part includes a wall member 22, and the bar 19*a* is spaced from the latter by a slot 23. The members 21 and 22 have been included, to enable the buckle to withstand heavy loads. These members may be omitted when a lighter load is expected and material-saving openings can be provided instead.

The extension of the bar 18 in the plane of the associated housing corresponds in length to that of the two other bars 19 and 20, plus the breadth of passage 24 separating the same taken in the same direction.

There is a further passage 25 between the bar 18 and the two bars 19 and 20, said passage running substantially in the plane of the housing in question but slightly inclined thereto. In the embodiments shown each passage 25 is formed in such a manner that it, from an entrance end 26, is slightly inclined towards an outlet end 27. The second bar 19 will thus have a lesser height at the outlet end 27 of the passage with respect to the lower side or inside surface of the buckle, than the height of the third bar 20 at the entrance end 26 of the passage.

The height of the strap passage 25 at its entrance end 26 substantially corresponds to twice the thickness of the strap to be used, while the passage 25 at its outlet end 27, as well as the passage 24, has a height substantially corresponding to the thickness of the strap.

FIG. 1 indicates how the strap is fitted into the attachment portion and FIG. 4, which may be the portion 11, shows the fitting of the strap more in detail.

The strap 13 is introduced into the passage 25 at its entrance end 26, and is folded around the bar 19, whereupon it is pushed upwards through passage 24, and thereafter passes out through the passage 25, on top of the bar 20.

This arrangement causes the issuing strap end to be foreced against the surface of the bar 20 facing the passage 25. When the buckle is used in a life vest, or in a harness, the strap is turned away from the plane of the housing (downwardly as shown in the drawing), thus producing the desired pressure, even if the passage 25 were to run more in parallel to the plane of the housing than is shown in the drawing.

The bar 19 is defined by surfaces, of which one is substantially parallel to the juxtaposed wall of the bar 18, and furthermore by surfaces which form substantially 90° corners 28, 29 and 30, at their intersections. The surfaces defining the bar 19 at the outlet end of the passage 25 are preferably arranged so they meet at a corner, which is less than 90°. A first folding and retention of a strap occurs at this corner.

The bar 20 is partly defined by a surface 31, which is substantially parallel with the juxtaposed surface of the bar 18, and furthermore by a surface 32, which is faces the passage 24. Those surfaces meet at a corner 33 forming approximately a right angle.

When the entering part of the strap 13 is tensioned the outgoing end 36 of the strap, is pressed against the side surface 31, which prevents the end part of the strap from being drawn backwards through the buckle. The bar 19 is fully enveloped by a loop of the strap, which is retained by friction at the corners 28, 29, 30 on the bar 19, as well as at the corner 33 on the bar 20.

The buckle is preferably formed so that the bar 19 will be elastically deformed, when the strap is subjected to a heavy load. The strap will then be forced against the side surface 32 on the bar 20 which will increase the retention force, and which will also provide a support for the bar 19, which will thus be able to withstand a high load.

An adjustment of the length of the strap is easily brought about by pushing the in-coming portion of the strap inwards. This having been done the engagement at the corners 28, 29, 30 and 33 is released making it possible to pull on, or to push in the issuing band end 36, so that the useful length of the strap is shortened or extended, as desired.

The embodiment shown is an example only, and variations of the components may be performed within the scope of the appended claims. With life vests and harnesses it may be advantageous to let the buckle have a slightly vaulted shape. It is also possible to arrange the passage 25 so that it will be inclined in a direction opposite to that shown in the drawing, i.e. so the height of bars 19 and 20 will increase in the direction from the entrance end towards the outlet end.

The bar 18 need not extend the full length of the first strap passage, 25, and in order to reduce weight and save material it is possible to substitute for the broad bar 18, two narrower bars, one at the entrance end, and one at the oulet end of the passage 25.

What I claim is:

1. A buckle for a strap comprising:

(a) a generally planar housing including a pair of oppositely located rectangular sidewalls, and at least three parallel bars extending between said sidewalls for the adjustable retention of the strap, said bars being arranged to provide (b) a first strap passage having an entrance end through the endmost portion of said housing at the narrower ends of said rectangular sidewalls, and an outlet end disposed centrally of said rectangular sidewalls and opening within said housing into an enlarged recess within said housing between said rectangular walls, said first passage extending substantially in the direction of the longer sides of said rectangular sidewalls, said sidewalls and said recess defining an extension of said first strap passage within said housing beyond said outlet end, and said first passage being defined at one side by one of said bars and at its opposite side by two further ones of said bars, the side of said one bar remote from said first passage being an outside surface of the buckle, and (c) a second strap passage having an external entrance end at one of said longer sides of said rectangular side-walls remote from the endmost portion of said housing and an outlet end opening into said first strap passage, and separating said two further bars and extending substantially parallel to said narrower ends of said rectangular sidewalls.

2. A buckle according to claim 1, one of said two further bars, being remote from the entrance end of said first strap passage, having three plane surfaces intersecting at sharp corners, substantially at three right angles.

3. A buckle according to claim 1, said first strap passage being arranged with such an inclination, that the heights of said two further bars gradually decrease in the direction from the entrance end of said first strap passage, toward its outlet end with respect to the inside surface of the buckle.

4. A buckle according to claim 1, said first strap passage being so inclined, that the heights of said two further bars gradually change in the direction from the entrance end of the first strap passage, toward its outlet end with respect to to the inside surface of the buckle.

5. A buckle for a strap comprising:

(a) a generally planar housing including a pair of oppositely located sidewalls, and at least three parallel bars extending between said sidewalls for the adjustable retention of the strap, said bars being arranged to provide (b) a first strap passage having an entrance end through the endmost portion of said housing and an outlet end opening into a recess within said housing, said first passage extending substantially in the plane of said housing, and said first passage being defined at one side by one of said bars and at its opposite side by two further ones of said bars, the side of said one bar remote from said first passage being an outside surface of the buckle, and (c) a second strap passage having an external entrance end remote from the endmost portion of said housing and an outlet end opening into said first strap passage, and separating said two further bars and extending substantially perpendicularly to the plane of said housing, one of said two further bars being so dimensioned that under the influence of a maximum of estimated load, it will be elastically deformed in a direction to decrease the breadth of said second strap passage, the other of said two further bars being capable of acting through the strap therebetween against the deformed bar for limiting its elastic deformation.

* * * * *